US006202896B1

(12) United States Patent
Bonningue

(10) Patent No.: US 6,202,896 B1
(45) Date of Patent: Mar. 20, 2001

(54) PUMP AND A RECEPTACLE FITTED THEREWITH

(75) Inventor: Philippe Bonningue, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/441,999

(22) Filed: Nov. 18, 1999

(30) Foreign Application Priority Data

Nov. 20, 1998 (FR) ..... 98 14648

(51) Int. Cl.[7] ..... B67D 5/42

(52) U.S. Cl. ..... 222/321.1; 222/207; 222/321.2; 222/321.3; 222/321.8; 222/321.7

(58) Field of Search ..... 222/321.1–321.9, 222/207

(56) References Cited

U.S. PATENT DOCUMENTS 4,029,261 * 6/1977 Olegnowicz ..... 222/321.3
4,452,379 * 6/1984 Bundschuh ..... 222/207
4,726,747 * 2/1988 Skorka ..... 222/321.9
5,638,996 * 6/1997 Montaner et al. ..... 222/321.2
5,655,689 * 8/1997 Fuchs et al. ..... 222/321.3
5,697,530 * 12/1997 Montaner et al. ..... 222/321.2
5,704,519 * 1/1998 Crosnier et al. ..... 222/207

FOREIGN PATENT DOCUMENTS 2 728 809 A1 7/1996 (FR) .

* cited by examiner

*Primary Examiner*—J. Casimer Jacyna
(74) *Attorney, Agent, or Firm*—Oliff & Berridge, PLC

(57) ABSTRACT

The invention relates to a pump of the type including a moving member mounted to move relative to a support, the moving member having a central duct in which substance to be dispensed penetrates via at least one opening, the support co-operating with the moving member to define, around said central duct, a pump chamber of variable volume, said pump also having a membrane with a central portion in the form of a sleeve that is open at its top end and closed at its bottom end, said central duct being inserted in said central portion, the membrane being organized to isolate the pump chamber from the opening(s) of said central duct while the volume of the pump chamber is increasing and substance is being sucked into it. At least one of the membrane and the central duct is shaped to prevent a leakproof annular zone forming between the membrane and the central duct which would prevent the substance contained in the pump chamber from flowing via said central duct while the volume of the pump chamber is decreasing.

19 Claims, 6 Drawing Sheets

1
2
3
4
5
6
7
8
9
10
12
13
15
16
17
18
20
21
22
24
25
26
30
31
32
33
34
35
36
37
40
41
42
50
51
52
53
X

PUMP AND A RECEPTACLE FITTED THEREWITH

The present invention relates to a pump and to a receptacle fitted with such a pump and containing a liquid, for example a cosmetic cream.

BACKGROUND OF THE INVENTION

French patent 2 728 809 discloses a pump having a pushbutton mounted to move on a support which is secured to the receptacle containing the substance to be dispensed, the pushbutton comprising a circularly-cylindrical central duct having radial openings at its bottom end, the support defining around said duct an annular pump chamber of variable volume. A membrane made out of an elastomer is mounted on the support. The membrane has a circulary-symmetrical central portion in the form of a sleeve that is open at its top end and closed at its bottom end. The central duct of the pushbutton is inserted in the membrane until it bears against the end wall of the sleeve.

The membrane thus constitutes a resilient return member enabling the pushbutton to be brought back to its initial position after a quantity of substance has been dispensed.

In addition, during the return movement of the pushbutton the membrane isolates the pump chamber by pressing against the central duct, thus serving to prevent air from penetrating therein.

Such a pump has the advantage of comprising a small number of parts only and therefore of being relatively inexpensive to make.

Nevertheless, that prior art pump does not give entire satisfaction; the Applicant company has observed that the pushbutton tends to jam and/or that the quantity of substance tends to be irregular and poorly dispensed.

OBJECTS AND SUMMARY OF THE INVENTION

The present invention seeks to improve the reliability in operation of a pump of the type defined above, i.e. a pump of the type including a moving member mounted to move relative to a support, the moving member having a central duct in which substance to be dispensed penetrates via at least one opening, the support cooperating with the moving member to define, around said central duct, a pump chamber of variable volume, said pump also having a membrane with a central portion in the form of a sleeve that is open at its top end and closed at its bottom end, said central duct being inserted in said central portion, the membrane being organized to isolate the pump chamber from the opening(s) of said central duct while the volume of the pump chamber is increasing and substance is being sucked into it.

The invention achieves this by at least one of the membrane and the central duct being shaped to prevent a leakproof annular zone forming between the membrane and the central duct which would prevent the substance contained in the pump chamber from flowing via said central duct while the volume of the pump chamber is decreasing.

Preferably, at least one of the membrane and the central duct is shaped to bear against the other of the membrane and the central duct in predetermined locations of its periphery, at least during relative displacement between the moving member and the support.

Preferably, at least one of the membrane and the central duct has portions in relief against which the other one of the membrane and the central duct bears, at least during relative displacement between the moving member and the support.

By means of the invention, reliable operation of the pump is guaranteed, without the moving member jamming while the volume of the pump chamber is varying.

The above-specified portions in relief tend to prevent the membrane blocking the flow of substance coming from the pump chamber towards the opening(s) of the central duct and through which the substance to be dispensed penetrates while the volume of the pump chamber is decreasing.

These portions in relief also tend to hold the central duct of the moving member on the axis of the central portion of the membrane, which is favorable to satisfactory operation of the pump.

In a preferred embodiment, said portions in relief are made on the membrane, preferably being constituted by bulges that are uniformly distributed around the axis of the central portion of the membrane at its opening.

In a particular embodiment, the membrane has a flexible lip suitable firstly for isolating the pump chamber from a source of substance while the volume of said pump chamber is decreasing, and secondly to enable substance to penetrate into said pump chamber while the volume thereof is increasing.

In a particular embodiment, said flexible lip connects with said central portion of the membrane by forming a narrow annular groove that is downwardly open, and the support includes an inner skirt whose top end bears against the end wall of said groove to retain the membrane while the moving member is moving downwards to decrease the volume of the pump chamber.

In a particular embodiment the support has a double sealing lip bearing in leakproof manner against the tubular skirt of the moving member, the lip being downwardly open and extending concentrically around said central duct, said tubular duct defining the pump chamber in a radially-outward direction.

In a particular embodiment, said inner skirt forms a portion of a part fitted to the remainder of the support.

In a preferred embodiment, the above-mentioned flexible lip has an annular rib whereby it can press in leakproof manner against the inner skirt of the support while the volume of the pump chamber is decreasing or when the pump is at rest, said inner skirt communicating internally with the source of substance and including above said annular rib openings that enable the substance to penetrate into the pump chamber while the volume thereof is increasing and while said flexible lip is spaced apart from said inner skirt under the effect of the thrust from the substance flowing towards the pump chamber.

In a preferred embodiment, the flexible lip has a thin zone above said annular rib.

In a preferred embodiment, the central duct of the moving member is provided at its bottom end with at least one radial opening.

In a preferred embodiment, the moving member constitutes a pushbutton, said central duct being made integrally with a dispensing endpiece.

In a particular embodiment, the tubular skirt of the moving member slides inside a guide skirt of the support, said guide skirt co-operating with the inner skirt to form an upwardly-open annular groove communicating via at least one air intake orifice with the source of substance, the tubular skirt of the moving member bearing in leakproof manner against the guide skirt when the moving member is at rest and the volume of the pump chamber is at a maximum.

In a particular embodiment, the pump has a return spring for returning the moving member towards an initial position after a quantity of substance has been dispensed.

Advantageously, the return spring is constituted by a helical spring working in compression.

Preferably, the spring is disposed on the axis of the membrane so that the top end of the spring bears against the bottom end of the central portion of the membrane.

The presence of a return spring is advantageous since it makes it possible to have a wider choice of materials for constituting the membrane since the membrane need not be prestressed or it can be prestressed, but only to a relatively small extent.

The presence of a spring also enlarges the range of substance that can be dispensed, since it becomes easier to find a membrane material that is compatible with the substance for dispensing.

The invention also provides a receptacle fitted with a pump as defined above.

BRIEF DESCRIPTION OF THE DRAWINGS

Other characteristics and advantages of the present invention will appear on reading the following detailed description of a non-limiting embodiment of the invention and of a variant, and on examining the accompanying drawings, in which.

MORE DETAILED DESCRIPTION

Figure 1:
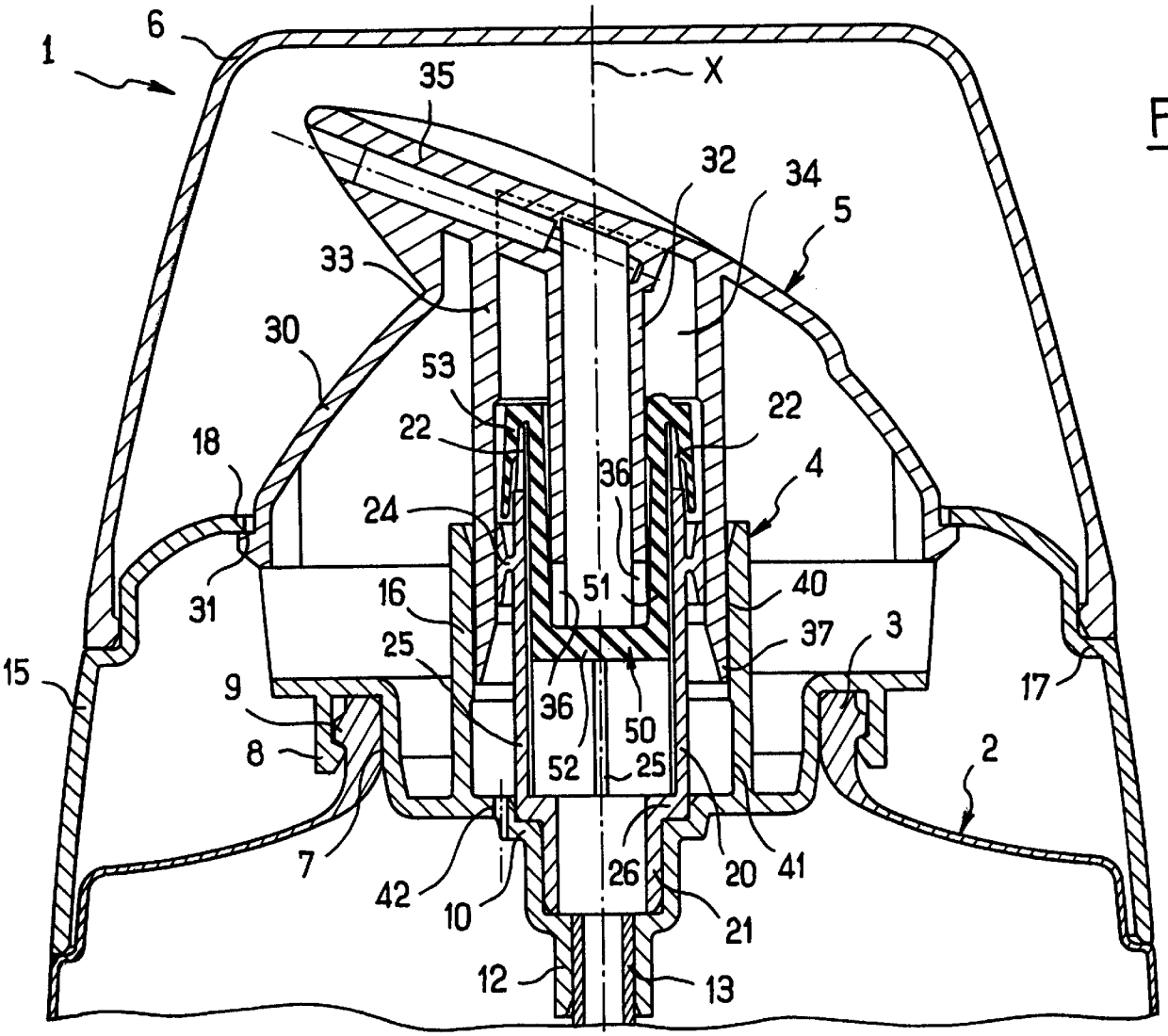
FIG. 1 is a diagrammatic view of the top portion of a receptacle fitted with a pump of the invention.

FIG. 1 shows a receptacle 1 having a body 2 forming a tank, with the drawing showing only the top end thereof which has a neck 3 onto which a support 4 is snap-fastened.

The support 4 guides sliding movement of a pushbutton 5 along an axis X, and it serves to receive a removable protective cap 6 that covers the pushbutton 5 prior to first use.

The support 4 has a sealing skirt 7 bearing in leakproof manner against the inside surface of the neck 3.

The sealing skirt 7 is extended radially firstly outwards by fixing tabs 8 snap-fastened onto an annular rim 9 on the neck 3, and secondly inwards by means of a stepped wall 10 defining an endpiece 12 for receiving a dip tube 13 that can be seen in part in the drawing.

An outer skirt 15 and a guide skirt 16 are integrally formed as a molding of plastics material, together with the sealing skirt 7, the fixing tabs 8, and the stepped wall 10.

The outer skirt 15 extends around the neck 3 of the receptacle and has a shoulder 17 on which the protective cap 6 bears.

The top edge 18 of the outer skirt 15 retains the pushbutton 5 at rest, as described below.

The support 4 has an inner skirt 20 constituted by a fitted part having a shouldered bottom end 21 that is engaged by force in the stepped wall 10.

Figure 2:
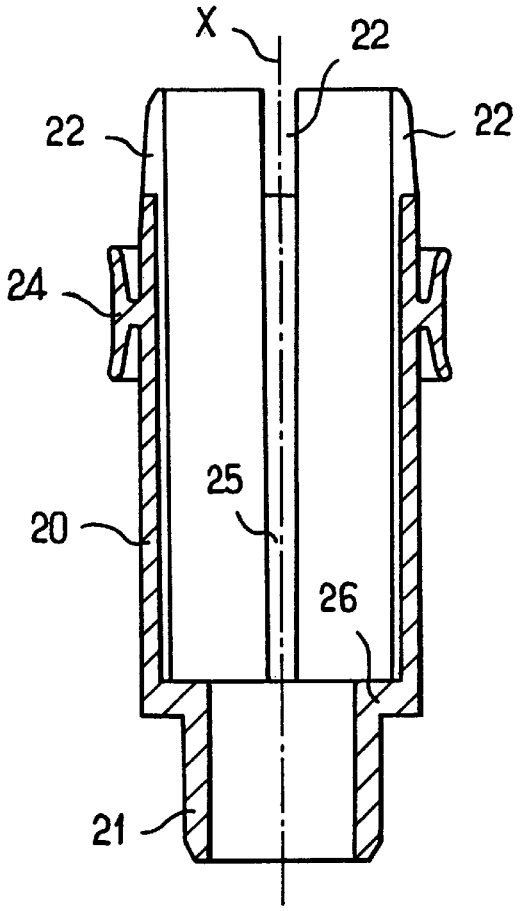
FIGS. 2 and 3 show the inner skirt of the support on its own.
Figure 3:
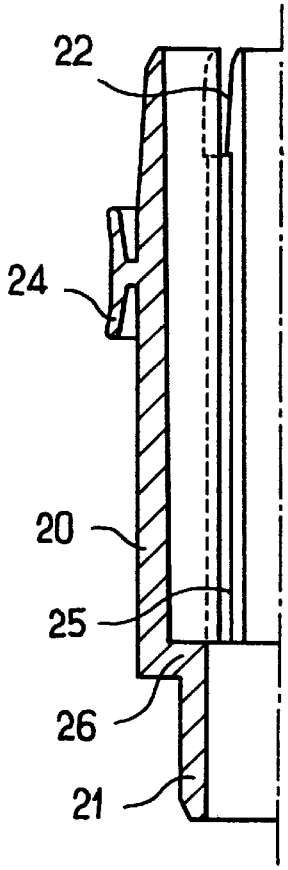

The inner skirt 20 has a perceptibly tapering top end provided with openings 22, as can be seen more particularly in FIGS. 2 and 3.

In the example described, these openings 22 are in the form of slots extending parallel to the axis X, being extended downwards by grooves 25 extending along the radially-inner surface of the inner skirt 20 as far as a step 26.

An annular double sealing lip 24 is integrally formed with the inner skirt 20 as a plastics molding.

The pushbutton 5 has an outer skirt 30 provided at its bottom end with teeth 31, the teeth coming into abutment against the top edge 18 of the outer skirt 15 of the support 4 when the pushbutton 5 is at rest in its high position, as shown in FIG. 1.

The pushbutton 5 has a central duct 32 about the axis X, and a concentric tubular skirt 33 defining an annular pump chamber 34 around the central duct 32.

The outer skirt 30, the tubular skirt 33, and the central duct 32 are formed integrally as a molding of plastics material together with a dispensing endpiece 35 which communicates internally with the central duct 32.

At its bottom end, the duct 32 has radial openings 36.

Figure 4:
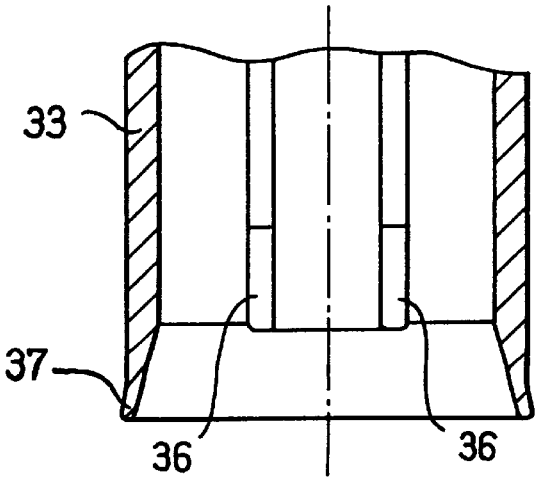
FIG. 4 shows part of the bottom end of the tubular skirt of the moving member on its own.

The bottom end of the tubular skirt 33 forms a sealing lip 37 that extends radially outwards to a small extent, as can be seen more particularly in FIG. 4.

The guide skirt 16 of the support 4 has a small annular setback 41 at its bottom end in its radially-inner surface.

When the pushbutton 5 is in its high position, the sealing lip 37 bears in leakproof manner against the circularly-cylindrical surface 40 of the top portion of the guide skirt 16, as shown in FIG. 1.

The inside of the receptacle is thus isolated from the surrounding air, thereby favoring good conservation of the substance.

When the pushbutton 5 is pushed down, the sealing lip 37 ceases to bear in leakproof manner against the guide skirt 16 because of the annular setback 41, thereby enabling the groove that is formed between the inner skirt 20 and the guide skirt 16 to communicate with the outside.

An air-intake orifice 42 is formed in the bottom of this groove to enable air to enter into the receptacle as it is emptied.

The inner skirt 20 serves to mount a membrane 50 having a central portion 51 in the form of a sleeve about the axis X, which sleeve is open at its top end and closed at its bottom end by an end wall 52.

Figure 5:
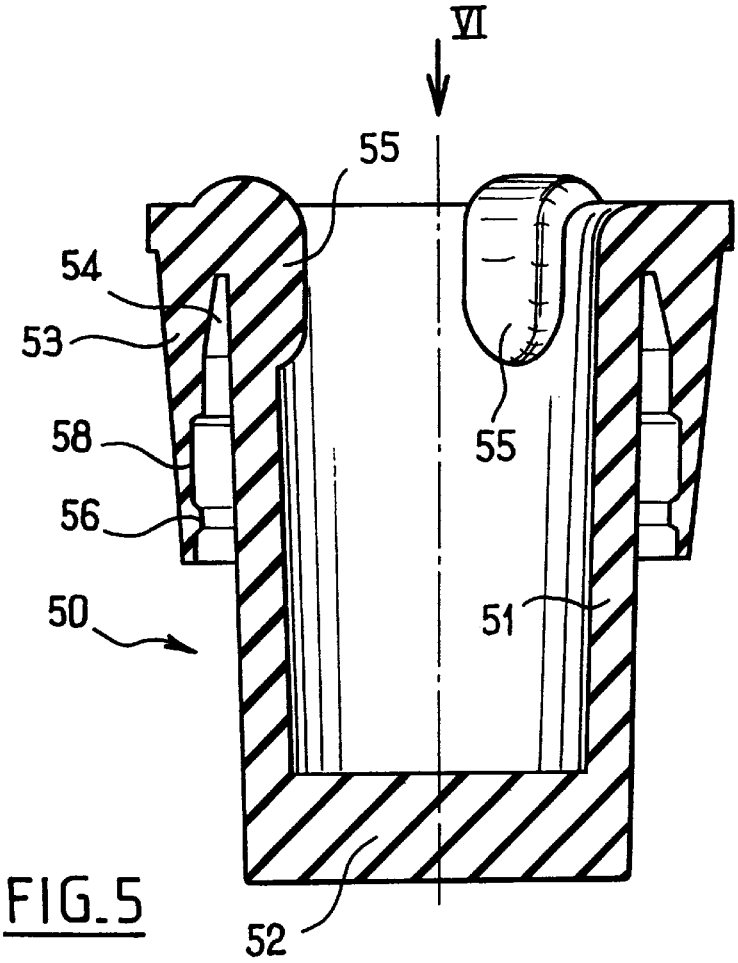
FIG. 5 is a diagrammatic axial section showing, on its own, the membrane fitted to the pump of FIG. 1.
Figure 6:
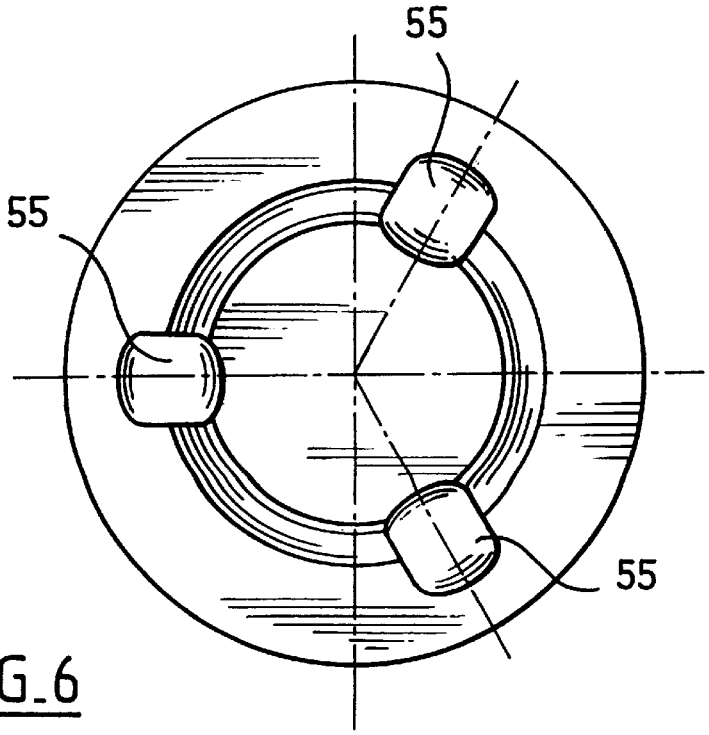
FIG. 6 is a plan view seen along arrow VI of FIG. 5.

The central portion 51 is extended radially outwards by a flexible annular lip 53, as can be seen more particularly in FIGS. 5 and 6.

Where it connects with the central portion 51, the flexible lip 53 forms a narrow annular groove 54 into which the top end of the inner skirt 20 is inserted until its free edge bears against the end wall of said groove. The groove 54 has a profile that is substantially the same as the profile of the top end of the inner skirt 20.

The height of the flexible lip 53 is greater than the height of the openings 22, and the flexible lip 53 has an annular rib 56 on its radially inner face close to the free end of the lip 53, which rib is suitable for bearing in leakproof manner against the radially-outer surface of the inner skirt 20, as shown in FIG. 1.

Above the rib 56, the flexible lip 53 also has a wall of reduced thickness 58 for facilitating radially-outward deformation thereof so as to enable the substance to reach the pump chamber 34, as described below.

Level with the opening in its central portion 51, the membrane 50 has portions in relief that are not circularly-symmetrical about the axis X, namely bulges 55 that serve a function which is described below.

In the embodiment described, there are three bulges 55 uniformly distributed angularly around the axis X, as can be seen in FIG. 6.

Each of these bulges 55 projects from the radially-inner surface of the central portion 51 over about one-fourth of the height thereof starting from its top end, and also extends radially outwards along the top face of the membrane 50 to a point substantially over the groove 54, as can be seen in FIG. 5.

When seen in section in a cross-section plane, each of these bulges 55 is convex towards the axis X, as can be seen in FIG. 6.

The central duct 32 of the pushbutton 5 is inserted in the central portion 51 of the membrane 50 until its bottom end bears against the end wall 52 of the membrane 50, as shown in FIG. 1.

The bulges 55 in the example described then press against the circularly-cylindrical surface of the central duct 32. Nevertheless, in general terms, it is not essential for the bulges 55 to press against the central duct 32 when the pushbutton is at rest.

When the pushbutton 5 is at rest, the central portion 51 of the membrane 50 is under a small amount of tension, so as to hold the teeth 31 in abutment against the top edge 18 of the outer skirt 15.

The double sealing lip 24 presses in leakproof manner against the radially-inner surface of the tubular skirt 33 regardless of whether the pushbutton 5 moves up or down.

The radially-inner surface of the central portion 51 of the membrane is slightly conical, converging downwards, in its portion that extends beneath the bulges 55 to slightly above the top ends of the openings 36, after which it is circularly-cylindrical about the axis X.

When the membrane 50 is in place, the flexible lip at rest comes to press via the rib 56 against the inner skirt 20.

The support 4, the pushbutton 5, and the membrane 50 constitute a pump whose operation is as follows.

Figure 7:
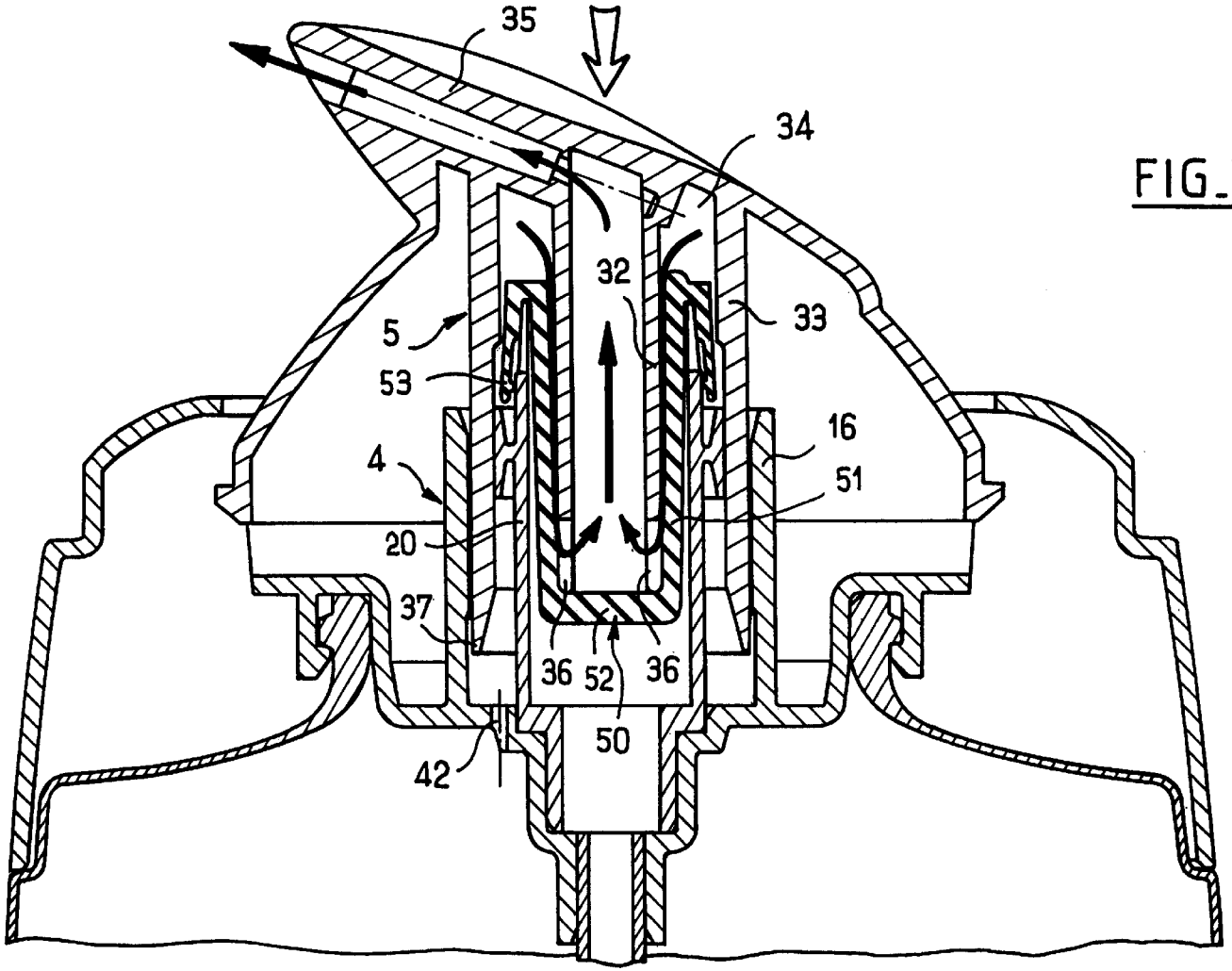
FIG. 7 shows how the pump operates when pressure is applied to the pushbutton.

When the user presses on the pushbutton 5, as shown in FIG. 7, the central duct 32 moves the end wall 52 of the membrane 50 downwards, with the membrane deforming elastically as it stretches to accompany the movement of the central duct 32.

The pump is assumed to be primed, i.e. it is assumed that the pump chamber 34 is full of substance.

While the pushbutton 5 is moving downwards, the substance contained in the pump chamber 34 is expelled between the central duct 32 and the central portion 51 of the membrane and reaches the radial openings 36 of the central duct 32, and then the dispensing endpiece 35.

The flexible lip 53 bears in leakproof manner against the inner skirt 20 during the downwards movement of the pushbutton 5.

The sealing lip 37 of the tubular skirt 33 of the pushbutton 5 ceases to bear in leakproof manner against the guide skirt 16 on reaching the annular setback 41 after the pushbutton 5 has moved down over a certain stroke, thereby putting the inside of the receptacle into communication with the outside via the air-intake orifice 42 and the clearance that exists between the guide skirt 16 and the tubular skirt 33.

Between them, the bulges 55 leave passages for the substance and prevent a leakproof annular zone being formed between the central duct 32 and the central portion 51 of the membrane 50, which zone might not be overcome by the pressure of the substance, and as a result the substance can flow all the way to the radial openings 36, the membrane 50 being capable of moving away a little from the central duct in the vicinity of the top ends of the openings 36 under drive from the pressure of the substance.

The projections 55 also tend to keep the central duct 32 coaxial with the inner skirt 20 and to guarantee that the top portion of the membrane which is hooked on the inner skirt 20 is held in place.

In addition, the narrowness of the groove 54 ensures that the membrane 50 is well secured on the inner skirt 20 and prevents the top portion of the membrane 50 being entrained in displacement with the central duct 32.

When the user releases the pushbutton 5, it is returned upwards by the central portion 51 of the membrane which tends to return to its initial shape.

During the return movement of the pushbutton 5, the central portion 51 of the membrane 50 isolates the radial openings 36 of the pump chamber 34, and the suction which is established therein causes the flexible lip 53 to be moved away and causes substance to be drawn in from the receptacle.

Figure 8:
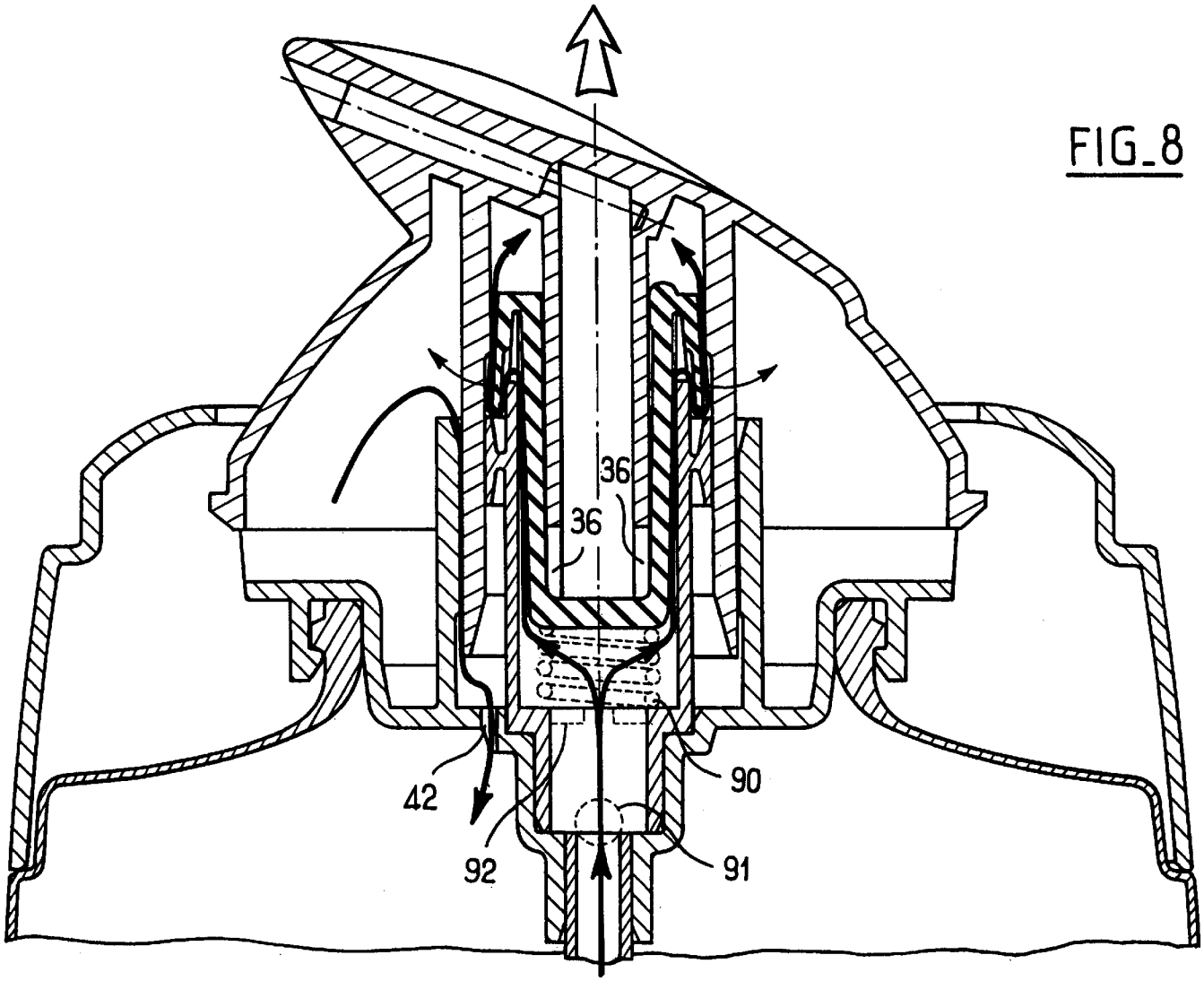
FIG. 8 shows how the pump operates when the pushbutton is released.

More precisely, the substance that then reaches the pump chamber 34 flows via the grooves 25 in the inner skirt 20 along the central portion 51 of the membrane 50, passes through the inner skirt 20 via the openings 22, and then passes round the flexible lip 53 and rises up the outside thereof, as shown in FIG. 8.

While the pushbutton 5 is rising, air can reach the receptacle via the clearance that exists between the guide skirt 16 and the tubular skirt 33 via the air intake orifice 42, until the sealing lip 37 again comes to press in leakproof manner against the guide skirt 16 when the pushbutton 5 reaches its high position, as explained above.

Naturally, the invention is not limited to the embodiment described above.

Figure 9:
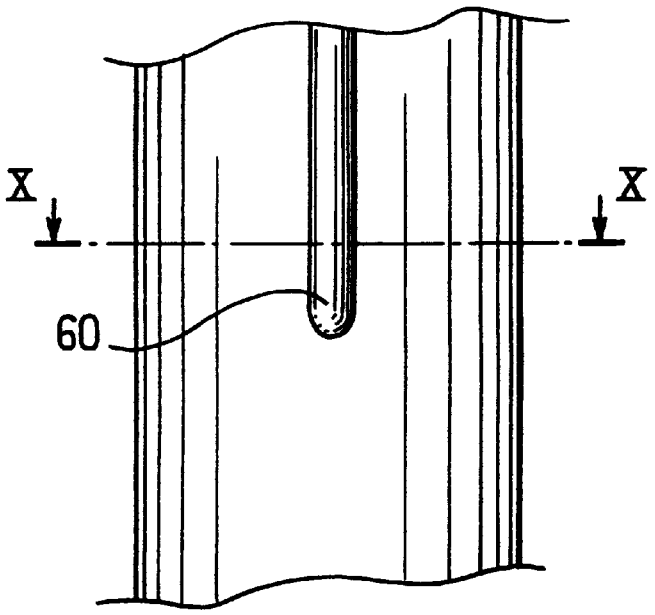
FIG. 9 is a fragmentary diagram of a pushbutton in a variant embodiment of the invention.
Figure 10:
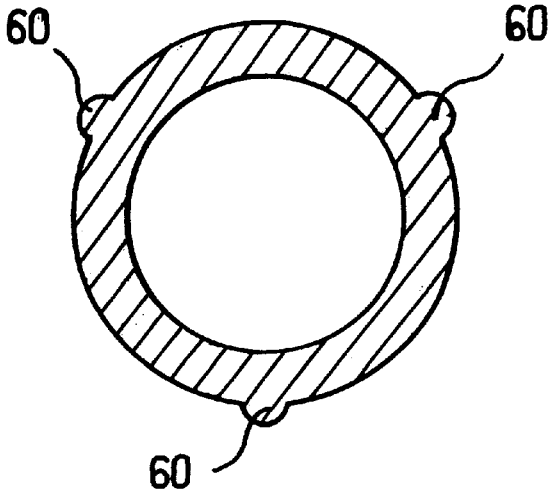
FIG. 10 is a cross-section on line X—X of FIG. 9.

In particular, it is possible to use a membrane in which the radially-inner surface of the central portion is circularly symmetrical, with the bulges 55 being replaced by bulges 60 formed on the central duct 32, as shown in FIGS. 9 and 10.

It is also possible to assist or cause the pushbutton to undertake its return movement by means of a helical spring 90 as shown in dashed lines in FIG. 8.

The spring is received inside the inner skirt 20, it works in compression, and its bottom end bears against the setback 26 while its top end bears against the bottom face of the end wall 52 of the membrane.

It is also possible to place a non-return valve upstream from the membrane, said valve opening while the substance is being sucked into the pump chamber and presenting a leak so as to avoid preventing the moving member from moving while a quantity of substance is being dispensed.

The valve can be implemented, for example, by means of a ball 91 as shown in dashed lines in FIG. 8, with the endpiece 12 serving as a seat.

Portions in relief 92 are formed on the inner surface of the inner skirt so as to hold the ball 91 close to its seat.

The ball 91 is selected to be very rough so as to create a leak that ensures that the downward movement of the central portion of the membrane is not impeded while a quantity of substance is being dispensed.

The ball 91 makes it possible to prime the pump by actuating the pushbutton a few times.

The membrane may also be made out of at least two different materials.

Thus, to make the flexible lip 53, it is possible to use a material that is softer than the material used for making the spring-forming portion 51.

By way of example, the same elastomer can be used but with differing quantities of filler.

By using different materials, it is possible to use a material which is relatively hard for the central portion 51, which is favorable to obtaining a good spring effect, without thereby impeding operation of the flexible lip 53.

In an embodiment that is not shown, a helical spring is placed around the central duct and has its bottom end bearing against the top end of the membrane while its top end bears against the pushbutton 5.

What is claimed is:

1. A pump of the type including a moving member mounted to move relative to a support, the moving member having a central duct in which substance to be dispensed penetrates via at least one opening, the support co-operating with the moving member to define, around said central duct, a pump chamber of variable volume, said pump also having a membrane with a central portion in the form of a sleeve that is open at its top end and closed at its bottom end, said central duct being inserted in said central portion, the membrane being organized to isolate the pump chamber from the opening(s) of said central duct while the volume of the pump chamber is increasing and substance is being sucked into it, wherein at least one of the membrane and the central duct is shaped to prevent a leakproof annular zone forming between the membrane and the central duct which would prevent the substance contained in the pump chamber from flowing via said central duct while the volume of the pump chamber is decreasing.

2. A pump according to claim 1, wherein at least one of the membrane and the central duct is shaped to bear against the other of the membrane and the central duct in predetermined locations of its periphery, at least during relative displacement between the moving member and the support.

3. A pump according to claim 2, wherein at least one of the membrane and the central duct has portions in relief against which the other one of the membrane and the central duct bears, at least during relative displacement between the moving member and the support.

4. A pump according to claim 3, wherein said portions in relief are made on the membrane.

5. A pump according to claim 4, wherein said portions in relief are constituted by bulges that are uniformly distributed around the axis of the central portion of the membrane at its opening.

6. A pump according to claim 1, wherein the membrane has a flexible lip suitable firstly for isolating the pump chamber from a source of substance while the volume of said pump chamber is decreasing, and secondly to enable substance to penetrate into said pump chamber while the volume thereof is increasing.

7. A pump according to claim 6, wherein said flexible lip connects with said central portion of the membrane by forming a narrow annular groove that is downwardly open, and wherein the support includes an inner skirt whose top end bears against the end wall of said groove to retain the membrane while the moving member is moving downwards to decrease the volume of the pump chamber.

8. A pump according to claim 7, wherein said inner skirt forms a portion of a part fitted to the remainder of the support.

9. A pump according to claim 6, wherein the membrane is made of at least two different materials, and wherein the flexible lip is made of a material that is softer than the spring-forming portion of the membrane.

10. A pump according to claim 1, wherein the support has a double sealing lip bearing in leakproof manner against the tubular skirt of the moving member, the lip being downwardly open and extending concentrically around said central duct, said tubular duct defining the pump chamber in a radially-outward direction.

11. A pump according to claim 10, wherein the tubular skirt of the moving member slides inside a guide skirt of the support, said guide skirt co-operating with the inner skirt to form an upwardly-open annular groove communicating via at least one air intake orifice with the source of substance, the tubular skirt of the moving member bearing in leakproof manner against the guide skirt when the moving member is at rest and the volume of the pump chamber is at a maximum.

12. A pump according to claim 1, wherein the central duct of the moving member is provided, at its bottom end, with at least one radial opening.

13. A pump according to claim 1, wherein said moving member constitutes a pushbutton, said central duct being integrally formed with a dispensing endpiece.

14. A pump according to claim 1, having a return spring for returning the moving member towards an initial position after a quantity of substance has been dispensed.

15. A pump according to claim 14, wherein the return spring is constituted by a helical spring working in compression.

16. A pump according to claim 15, wherein the spring is disposed on the axis of the membrane so that the top end of the spring bears against the bottom end of the central portion of the membrane.

17. A pump according to claim 1, including a non-return valve upstream from the membrane, said valve opening while substance is being sucked into the pump chamber, and presenting a leak so as to avoid preventing displacement of the moving member while a quantity of substance is being dispensed.

18. A pump according to claim 1, wherein the membrane is made of at least two different materials.

19. A receptacle fitted with a pump as defined in claim 1.

* * * * *